US006779991B2

(12) United States Patent
Leonhard

(10) Patent No.: US 6,779,991 B2
(45) Date of Patent: Aug. 24, 2004

(54) AXIAL PISTON PUMP

(75) Inventor: Todd W. Leonhard, Sheboygan, WI (US)

(73) Assignee: Thomas Industries Inc., Sheboygan, WI (US)

( * ) Notice: Subject to any disclaimer, the term of this patent is extended or adjusted under 35 U.S.C. 154(b) by 0 days.

(21) Appl. No.: 10/283,411

(22) Filed: Oct. 29, 2002

(65) Prior Publication Data

US 2004/0081568 A1 Apr. 29, 2004

(51) Int. Cl.[7] ..... F04B 17/04; F04B 35/04

(52) U.S. Cl. ..... 417/417; 417/423.14; 128/200.14

(58) Field of Search ..... 417/415–417, 417/495, 545, 423.14, 423.15; 137/510, 907; 128/200.14, 200.18, 200.21; 239/338

(56) References Cited

U.S. PATENT DOCUMENTS

| | | | | |
|---|---|---|---|---|
| 3,692,335 A | | 9/1972 | Vickers et al. | |
| 4,090,816 A | * | 5/1978 | Takahashi | 417/371 |
| 4,272,225 A | * | 6/1981 | Fujinaka et al. | 417/417 |
| 4,608,000 A | * | 8/1986 | Tominaga | 417/413.1 |
| 4,874,299 A | * | 10/1989 | Lopez et al. | 417/413.1 |
| 5,104,299 A | * | 4/1992 | Mizuno et al. | 417/417 |
| 5,537,820 A | * | 7/1996 | Beale et al. | 60/517 |
| 5,718,571 A | | 2/1998 | Rozek | |
| 6,135,144 A | | 10/2000 | Rozek | |
| 6,164,932 A | | 12/2000 | Tominaga et al. | |

FOREIGN PATENT DOCUMENTS

| | | |
|---|---|---|
| DE | 298 15 572 U1 | 1/1999 |
| DE | 199 26 186 A1 | 12/2000 |
| EP | 0 438 243 A1 | 7/1991 |

* cited by examiner

*Primary Examiner*—Justine R. Yu
*Assistant Examiner*—Han L Liu
(74) *Attorney, Agent, or Firm*—Quarles & Brady LLP

(57) ABSTRACT

A nebulizer pump includes an axial cylinder and piston arrangement and an electromagnet having a stator and an armature that drives the piston to reciprocate within the cylinder. The pump housing has a unitary partition defining an exhaust chamber in combination with the valve head that isolates air at the intake port from air at the exhaust port. The entire assembly can be clamped together by the housing or clamped separately and isolated from the housing by coil springs.

10 Claims, 8 Drawing Sheets

AXIAL PISTON PUMP

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to medical nebulizers and in particular to axial piston pumps with noise and operation characteristics suited for use with nebulizers.

Nebulizers are commonly used to deliver medication to persons with respiratory ailments. For example, bronchodialators, which are used to open airway passages, are commonly administered with nebulizers. A nebulizer changes liquid medication into a fine, atomized mist or vapor. The medicinal vapor is inhaled through a mouthpiece or mask and the atomized medication is able to penetrate deeply into one's airways because of the fine particle size. The liquid medicine is atomized by mixing it with compressed air or oxygen.

Typical nebulizers include a small compressor with a piston that reciprocates rapidly within a cylinder to pressurize the air. U.S. Pat. No. 6,135,144, assigned to the assignee of the present invention and hereby incorporated by reference as though fully set forth herein, discloses a compressor with a wobble piston. The piston is connected by a connecting rod to an eccentric mounted to a rotating shaft so that its head pivots as it slides within the cylinder.

In typical nebulizers, the pressurized air is forced out of the cylinder through a valve head and exhaust chamber to a hose leading to a mixing chamber. Internal conduit is usually necessary to direct the pressurized air leaving the valve head to the outlet port of the housing. After leaving the compressor, the pressurized air passes over an orifice leading from the liquid medicine to aspirate and atomize the medicine, which is then ordinarily mixed with ambient air, oxygen or oxygen enriched air for inhalation.

Persons with significant respiratory problems often require multiple nebulizer treatments every day, each taking several minutes to administer. It is also not uncommon for such persons to receive nebulizer treatments in hospitals, at work or other public places. It is thus important for the nebulizer compressors to operate discreetly. Quiet operation of the compressor can be obtained by insulating the housing, however, this adds bulk and can cause cooling problems. Mufflers can be added at the compressor exhaust, however, this adds hardware and thus cost.

SUMMARY OF THE INVENTION

The present invention provides an axial piston pump for use with a nebulizer having improved noise, vibration and manufacturing characteristics.

In one aspect the invention provides a pump with a cylinder and piston disposed along a piston axis and an electromagnet having a stator containing a wire coil driving an armature connected to the piston to reciprocate the piston within the cylinder along the piston axis. The pump has a valve head having an intake port and an exhaust port in communication with the cylinder. The housing defines an exhaust chamber in combination with the valve head that isolates air at the intake port from air at the exhaust port and an outlet extending outside the housing from the exhaust chamber.

In one preferred form, the housing defines a semi-circular exhaust partition and the valve head includes a raised semi-circular wall surrounding the exhaust port and separating it from the intake port. The wall and partition overlap axially in close relation. The valve head wall includes a groove containing an o-ring creating an air tight seal. The valve head can move with respect to the housing and thus a sliding seal is formed between the wall and the partition to seal the exhaust chamber.

The housing also defines an inlet and a baffle spaced from the inlet between the inlet and the intake port to reduce sound and cool the inside of the housing by redirecting intake air before compression.

In another aspect the invention provides a nebulizer pump having a housing with an inlet and an outlet and containing an electromagnet, cylinder, piston valve head and spring system. The spring system includes a plurality of axially spaced leaf springs disposed about and deflectable along the pivot axis and coupled to the piston and the armature of the electromagnet.

Preferably, each leaf spring includes a pair of concentric rings joined by a plurality of spokes and at least one leaf spring is connected to each of the armature and the piston. The springs are clamped in place at each axial side of the electromagnet by two sets of collars or spacer members.

In one form, at least one of the leaf springs is connected to the housing. Alternatively or in addition, the piston and armature can be isolated from the housing by a plurality of coil springs.

The present invention thus provides a compact axial piston pump with low operating vibration and noise such that is particularly suitable for use in a medical nebulizer device. The drive assembly can be suspended in the housing by spring stacks and top and bottom spring mounts to isolate the housing from vibration caused by the reciprocating elements of the assembly, and thereby reduce noise. The springs are selected so that the spring-mass system has a resonant frequency of approximately the input frequency and thereby improves efficiency and reduces vibration and noise. Additionally, the intake air is directed through the housing cavity by inlet baffles formed in the housing to further reduce noise as well as cool the drive assembly components. The unique exhaust chamber construction of the pump, formed by a partition wall of the housing and a mating wall of the valve head, simplifies assembly and cost by eliminating the need for separate exhaust tubing.

These and other advantages of the invention will be apparent from the detailed description and drawings.

DETAILED DESCRIPTION OF THE PREFERRED EMBODIMENTS

The present invention provides an axial piston pump designed for use with a medical nebulizer. To that end, the pump is compact, preferably hand-held, and has a preferred operating range of 10–15 psi (however, the pump could be designed to operate in a much wider range) with low external vibration and noise. The drive components are preferably suspended by two stacks of springs (spaced apart axially) to dampen the vibration caused by the reciprocating elements. The entire assembly (including the spring stacks) can be mounted to the housing through additional springs or resilient structures to further isolate the vibration of the assembly from the housing.

Figure 1:
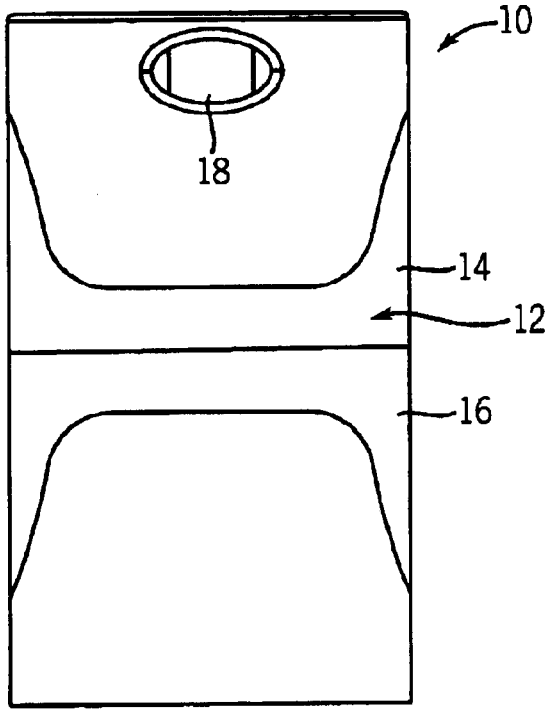
FIG. 1 is an intake side plan view of an axial piston pump of the present invention.
Figure 2:
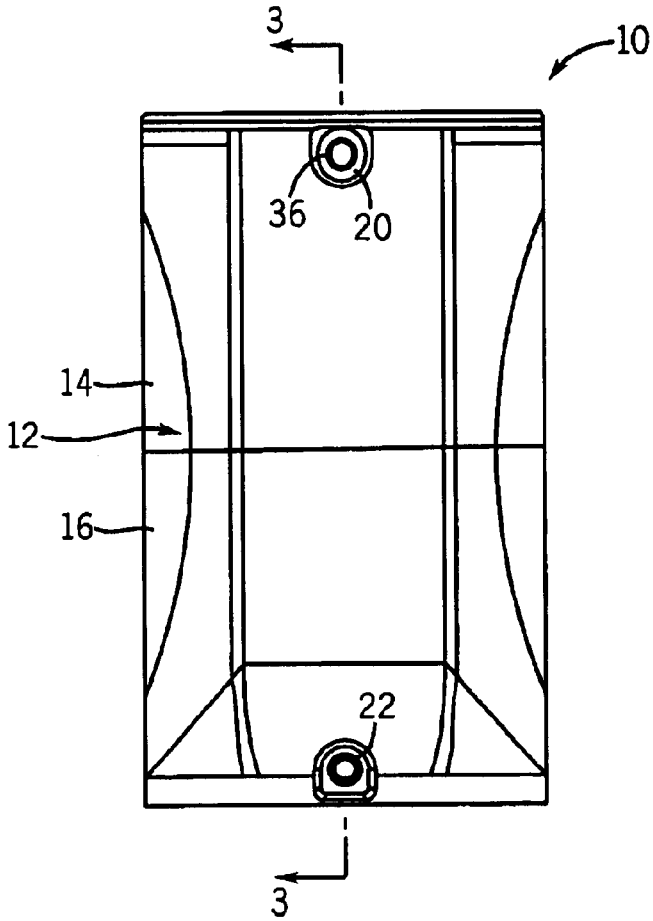
FIG. 2 is an exhaust side plan view of the axial piston pump of FIG. 1.

Referring to FIGS. 1–2, the pump 10 has a compact, oblong plastic housing 12 formed with a head shroud 14 and a rear shroud 16 suitably joined at the middle, for example by welding. The head shroud 14 has an air inlet opening 18 (see FIG. 1) and an air outlet opening 20 (see FIG. 2) at opposites sides near the top of the housing 12. The rear shroud 16 includes a socket 22 for a power cord.

Figure 3:
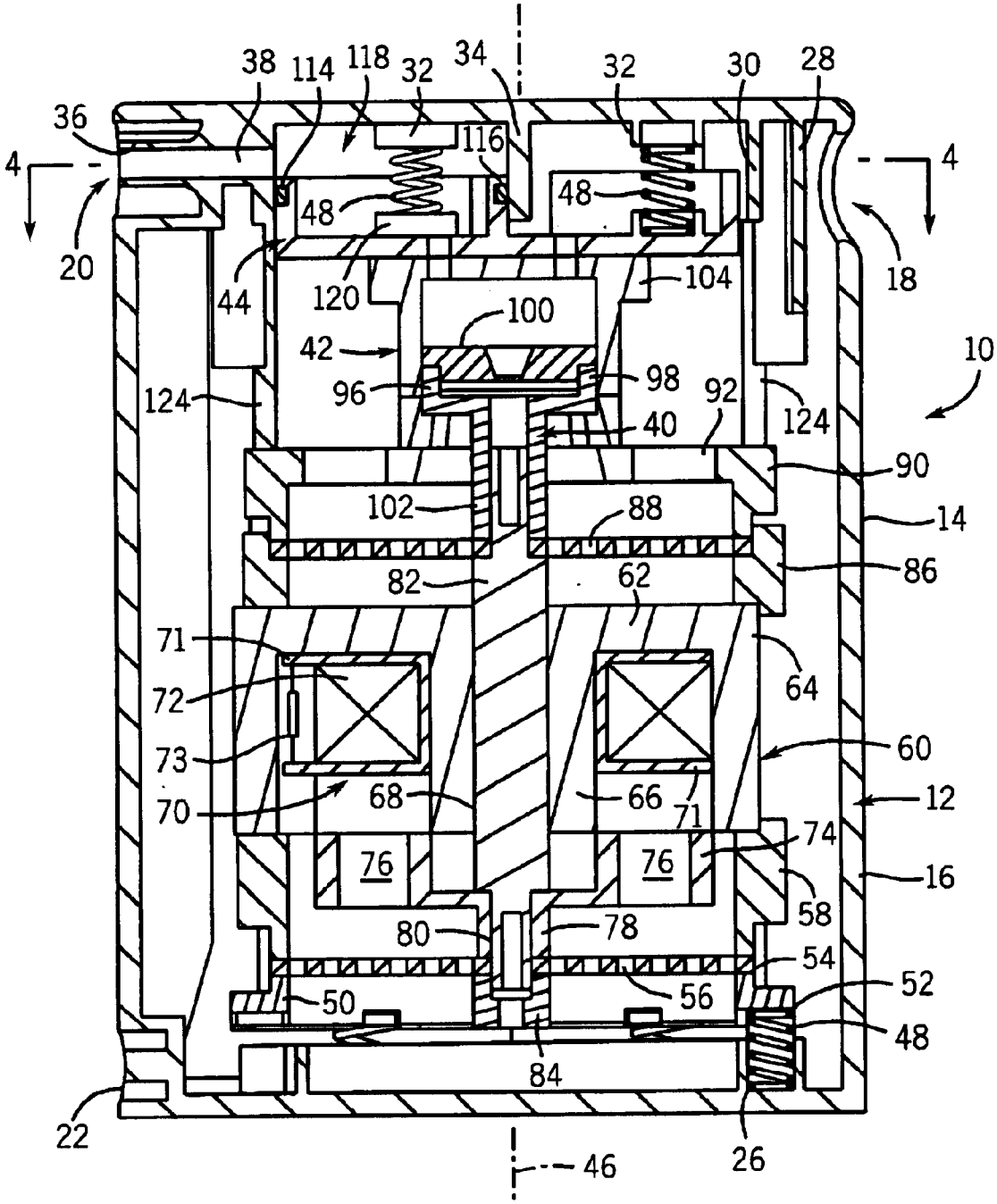
FIG. 3 is front cross-section view taken along line 3—3 of FIG. 2.
Figure 4:
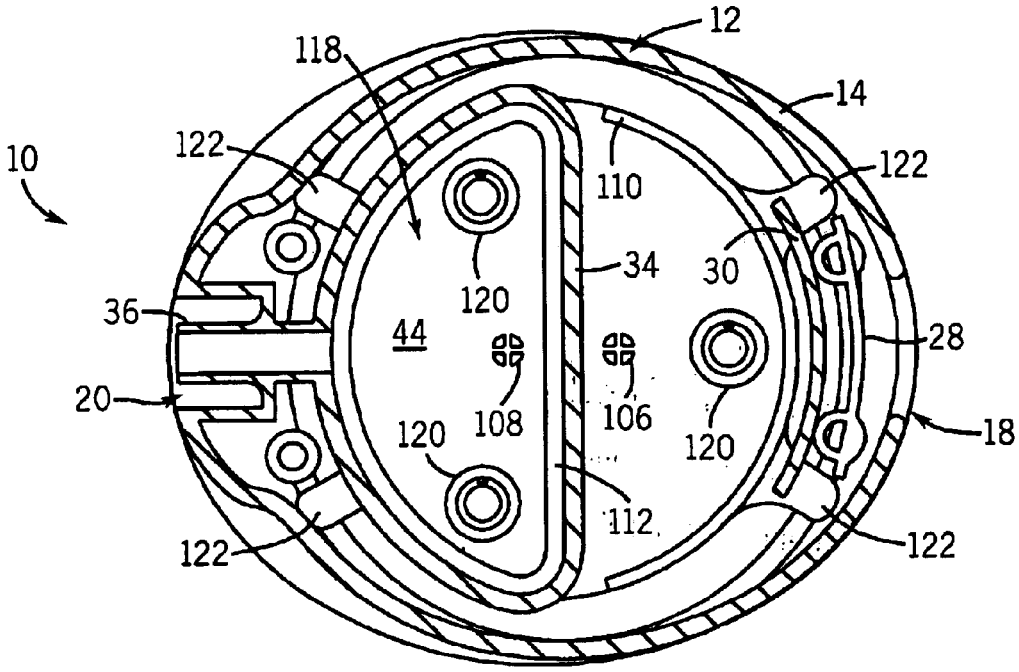
FIG. 4 is a top cross-section view taken along line 4—4 of FIG. 3.

Referring to FIGS. 3 and 4, the Inside bottom of the rear shroud 16 is formed with a circular upwardly opening channel 26. The inside top of the head shroud 14 is formed with two downwardly extending arcuate baffles 28 and 30. In approximate values, the baffle 28 sweeps a 60 degree arc, extends downwardly one inch and is spaced Inwardly ¼ inch from the inlet 18. The baffle 30 sweeps an 80 degree arc, extends down ½ inch and is spaced inwardly ¼ inch from the baffle 28. The head shroud 14 is also formed with three cylindrical spring mounts 32 spaced apart equi-angularly and extending down from the top 22 of the housing 12.

The head shroud 14 has an integral exhaust chamber defined in part by a unitary semi-circular exhaust partition 34 extending down from the top of the housing 12 roughly ½ inch. A cylindrical nipple 36 extends from an opening 38 in the partition 34 to the outlet opening 20 thereby creating a passage for exhaust air to escape from the housing 12. This unitary exhaust passage obviates the need for separate hoses or tubing that add expense and complicate assembly.

Referring to FIG. 3, the housing 12 contains the compressor drive assembly, generally including an electromagnet, a piston 40, a cylinder 42 and a valve head 44 all aligned concentrically about a piston axis 46. The entire assembly is isolated from the housing by six coil springs 48 spaced apart within the channel 26 in the bottom 24 of the housing 12.

Working from bottom to top in FIG. 3, a first retaining collar 50 having six spring pockets 52 is supported by the coil springs 48. The collar 50 has a stepped upper surface defining an inner ledge 54 supporting at least one leaf spring 56 having a pair of concentric circular rings joined by three spokes. The outer ring preferably includes hair pin elements disposed between the spokes.

The spring stack is clamped between the retaining collar 50 and a first spacer ring 58. The spacer ring 58 has a lesser outer diameter than that of the retaining collar 50 and notched top and bottom edges. The notch in the bottom edge is sized to receive the spring stack and the ledge 54 of the retaining collar 50. The upper notch receives the bottom edge of a stator 60 of the electromagnet 38.

The stator 60 is an annular member having a circular top wall 62 and two concentric cylindrical walls 64 and 66 extending downwardly from the top wall 62 to define a central bore 68 and a downwardly opening annular channel 70. A coil 72 is disposed in a bobbin 71 and placed in an upper part of the channel 70. A diode 73 is electrically coupled to the coil to rectify the alternating current input signal so that it drives an armature 74 in only one direction, preferably toward the stator.

The armature 74 has a series of axial bores 76 therethrough and slides in and out of a lower part of the stator when the coil is energized. The armature 74 has a downwardly extending hub 78 at its center with an axial bore 80 that receives a bottom end of a connecting rod 82 having a threaded bore in which a screw threads to secure a nut 84 that clamps against the inner rings of the springs.

A second spacer ring 86 fits around the top wall 62 of the stator 60 and clamps a second stack of leaf springs between its stepped down top edge and a bottom edge of a second retaining collar 90. The retaining collar 90 has a top circular wall 92 with a central opening 94 having a stepped inner surface receiving a bottom edge of the cylinder 42. The piston 40 has an enlarged head 96 defining a recess holding a piston cup 98 clamped to the head 96 by a cup retainer 100. The cup retainer 100 is secured by a screw threaded into the top of the connecting rod 82 through the bore of the piston shaft 102.

The piston is driven by the armature when the coil is energized to reciprocate within the cylinder. The stroke length is approximately 9 mm (4.5 mm in each direction) and is positioned approximately 1 mm from the top of the cylinder when at top dead center.

The cylinder 42 has an upper flange 104 that mounts the valve head 44. The valve head 44 is generally disk-shaped and has an intake port 106 and an exhaust port 108 in communication with the inside of the cylinder 42 and coved by flapper valves (not shown). An arcuate wall 110 extends upwardly from the periphery of the valve head 44 past the inner baffle 30 and a semi-circular wall 112 extends upwardly past the bottom edge of the semi-circular partition 34. The wall 112 includes a peripheral groove 114 containing an o-ring seal 116 so as to create an exhaust chamber 118 isolated from the interior of the housing and vented outside the housing through the nipple 36. The valve head 44 also includes three spring mounts 120 (two being in the exhaust chamber) for mounting three additional coil springs 48. The valve head 44 also has four spaced apart radial tabs 122 with bottom openings that receive the upper ends of four tie rods 124, the bottom ends of which are disposed in openings in the bottom retaining collar 50. The tie rods 124 thus unite the aforesaid components.

The reciprocating piston and armature can cause the assembly inside the housing to vibrate. The associated noise and movement is dampened by the coil springs so that the very little vibration is transferred to the housing. However, since the movement of the assembly is largely isolated from the housing, the vibration causes axially movement of the valve head relative to the housing partition. Thus, the o-ring creates a sliding seal between the valve head wall and the partition to seal off the exhaust chamber.

The vibration is also mitigated by the two spring stacks. The number and size of leaf springs is primarily a function of the mass of the piston and the power input frequency. The springs are selected so that in combination (between the two stacks) they result in a resonant frequency of the piston and springs (i.e., the spring-mass system) approximately equal to the input frequency, that is 50 or 60 Hertz. For example, in one preferred embodiment there is a stack of two springs at this location and a stack of three springs at the piston in a 115 v/60 Hz application and a stack of three springs here and a stack of four springs at the piston for a 230 v/50 Hz application. Operating at the resonant frequency improves efficiency and reduces vibration, and thereby noise.

Figure 6:
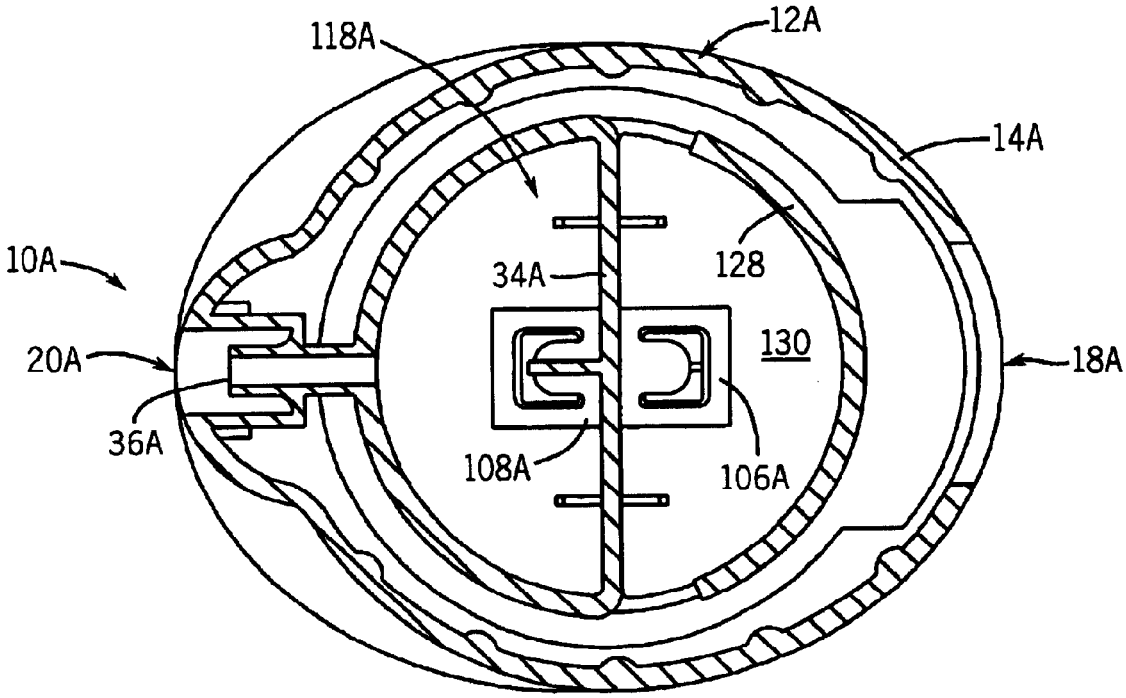
FIG. 6 is a top cross-section view taken along line 6—6 of FIG. 5
Figure 5:
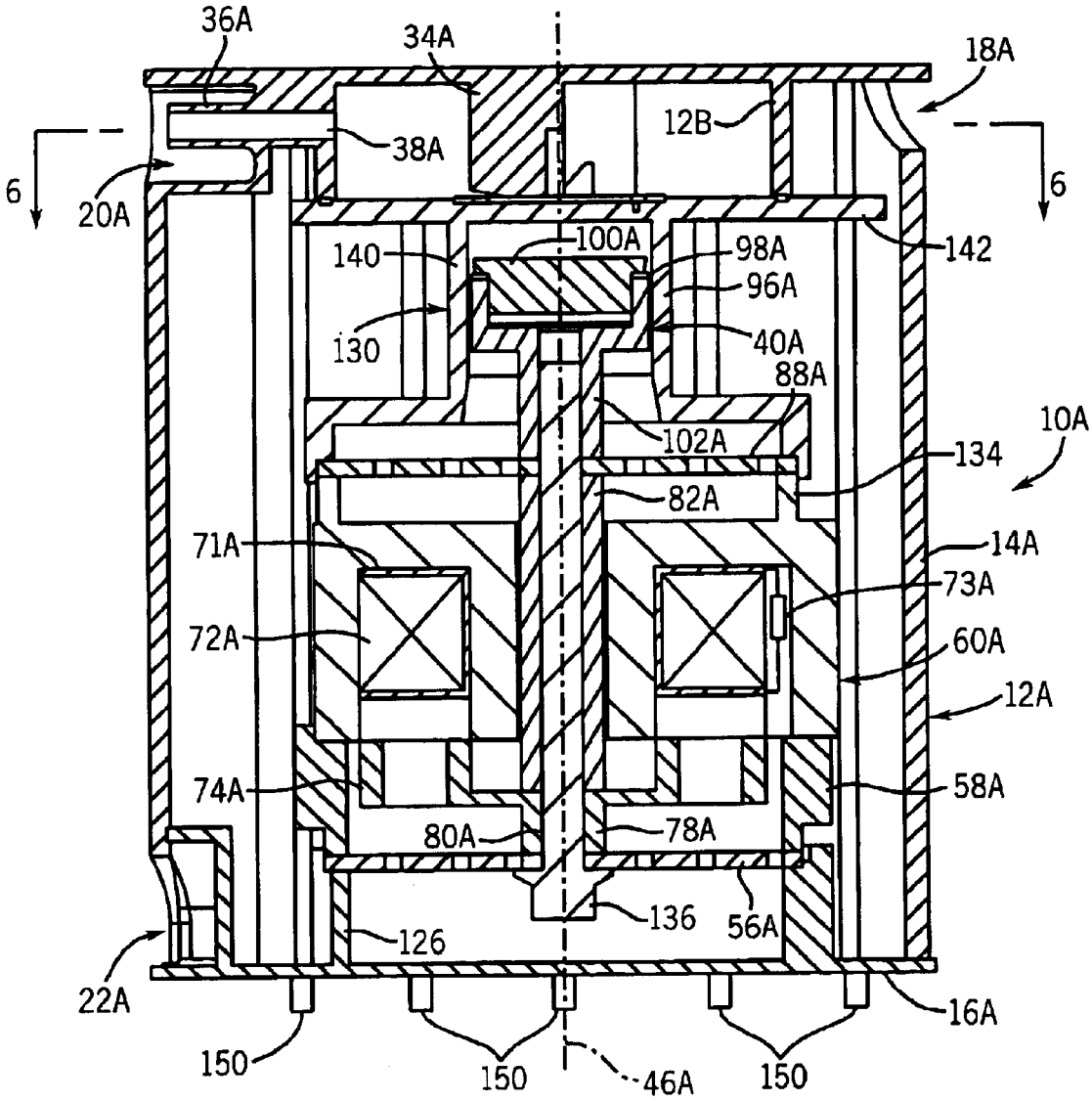
FIG. 5 is a front cross-section view similar to FIG. 3 of an alternate embodiment of the axial piston pump having a non-isolated spring mass system.
Figure 7:
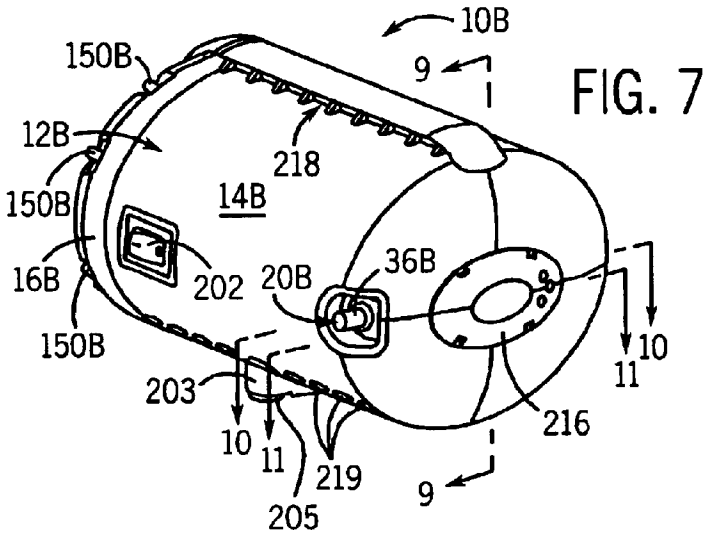
FIG. 7 is a perspective view of another alternate embodiment of the axial piston pump with a non-isolated spring mass system.
Figure 8:
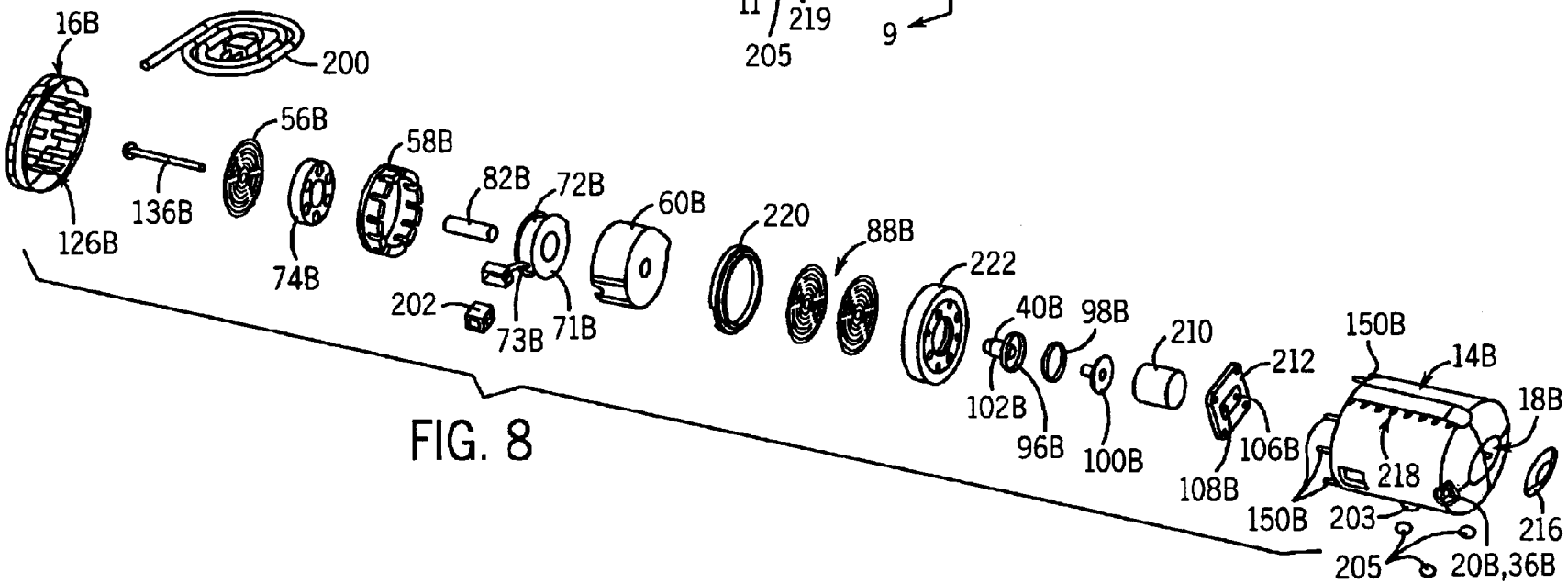
FIG. 8 is an exploded view of the pump of FIG. 7.
Figure 9:
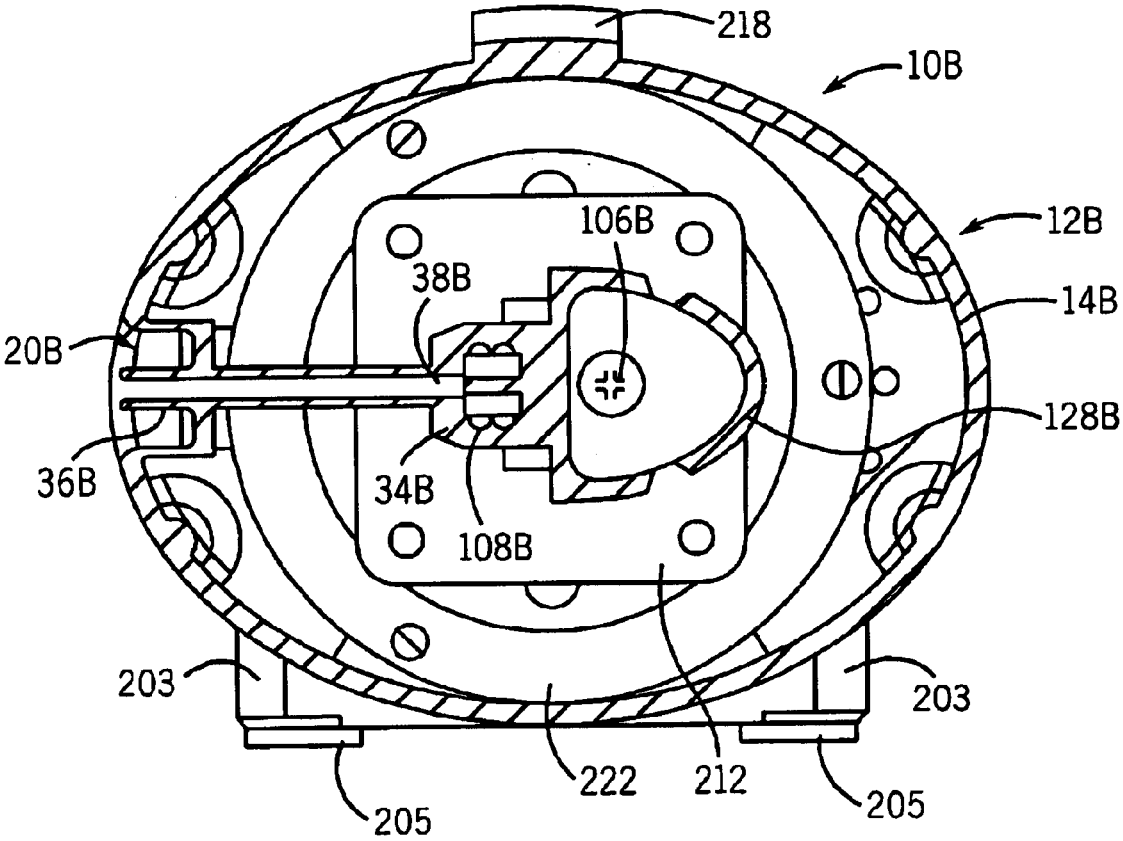
FIG. 9 is top cross-sectional view taken along line 9—9 of FIG. 7.
Figure 10:
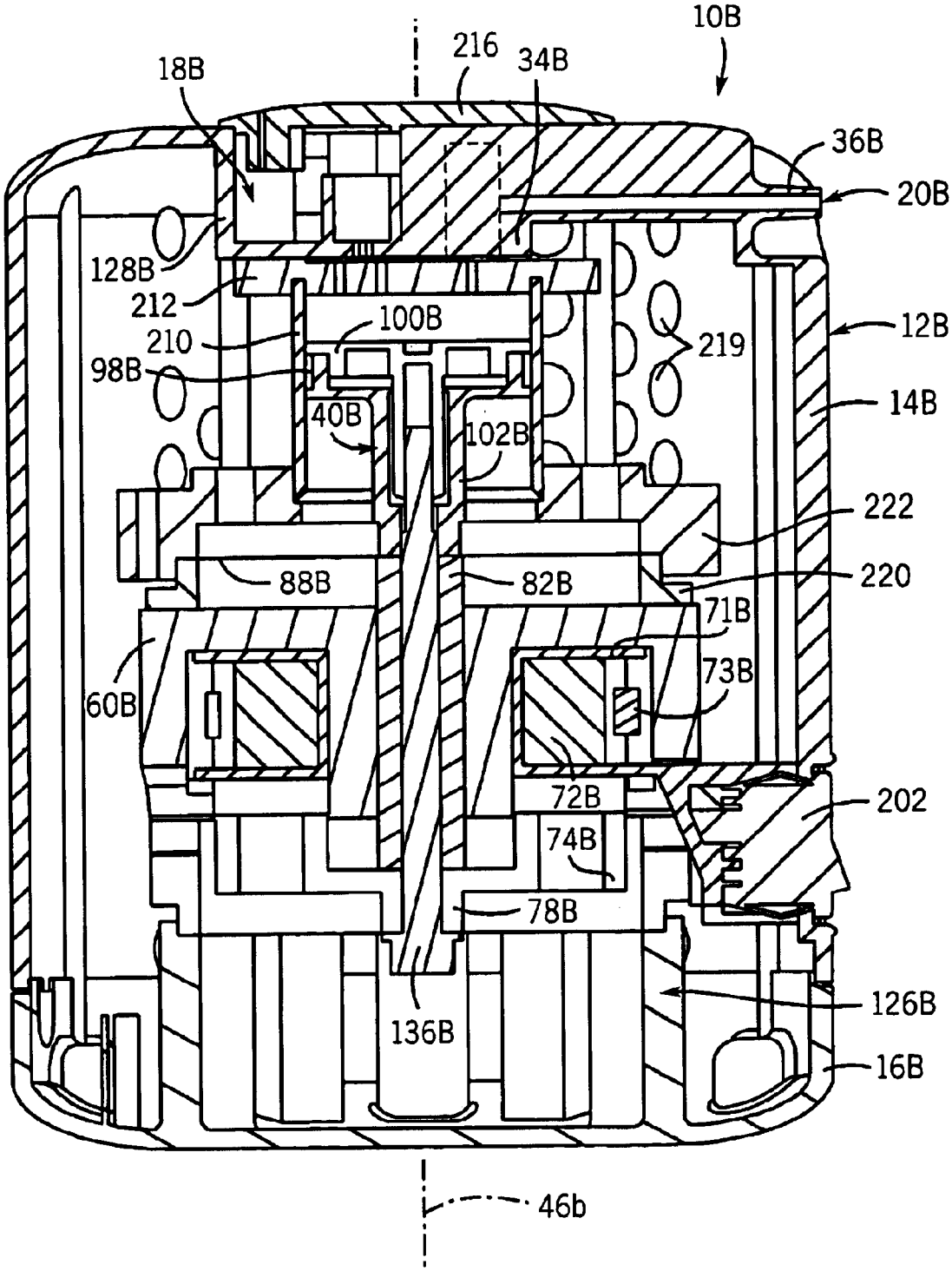
FIGS. 10 and 11 are two side cross-sectional views taken along respective lines 10—10 and 11—11 of FIG. 7.
Figure 11:
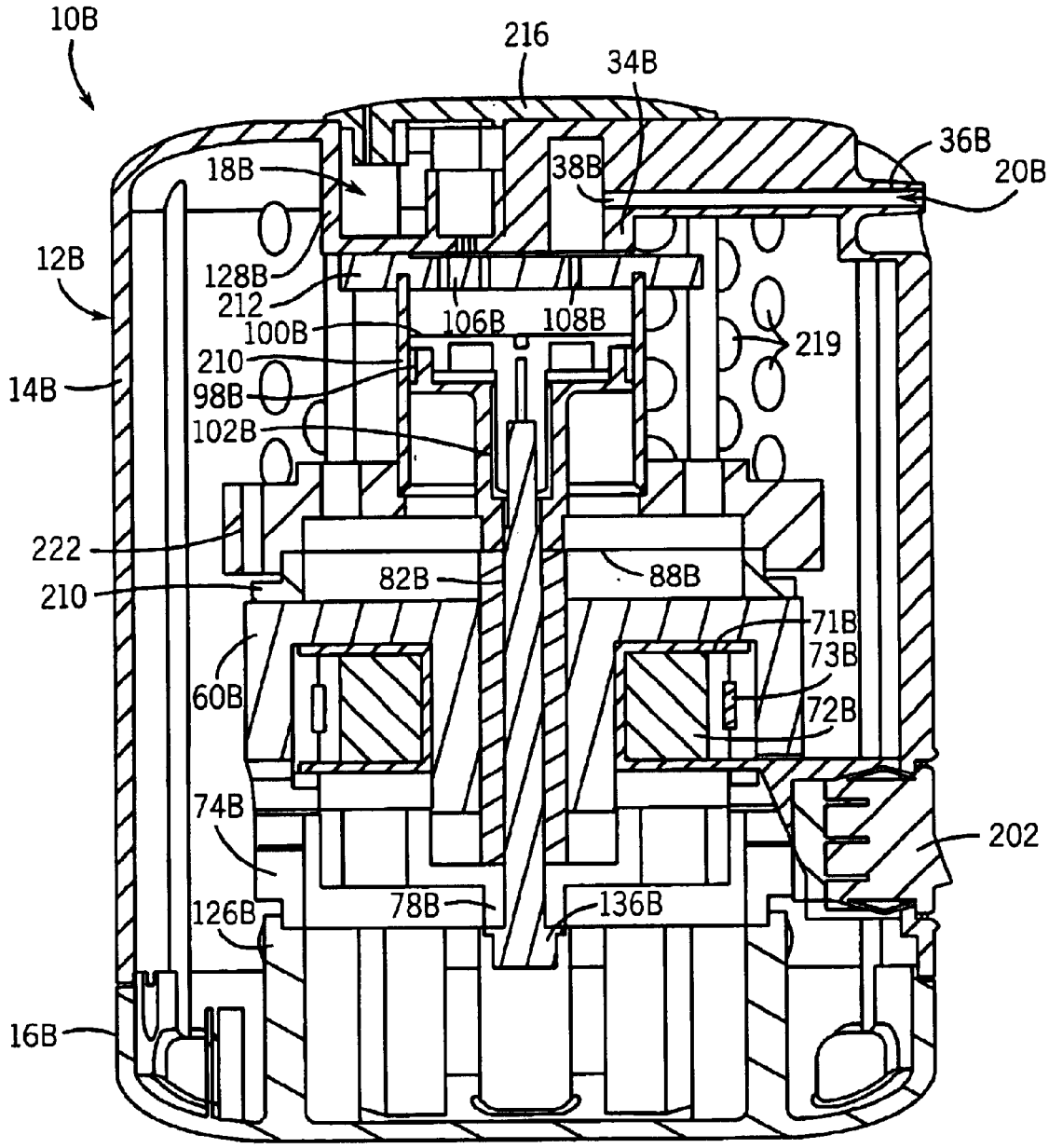

FIGS. 5 and 6 show an alternate embodiment of the pump in which the drive assembly is not isolated from the housing by coil springs. The housing parts clamp the assembly together and maintain the exhaust chamber seal between the housing partition and the valve head. This embodiment obviates the tie rods and eliminates the sliding seal described in the first embodiment. Components of this embodiment that are similar to the above-described embodiment are referred to with similar reference numerals albeit with the suffix "A".

In particular, the axial piston pump 10A has a compact housing 12A including a head shroud 14A and a rear shroud 16A joined at the bottom of the housing, preferably by heat staking (as known in the art) pins 150 extending from the head shroud through corresponding openings in the bottom of the rear shroud and thus permanently mating the shrouds. The rear shroud 16A defines a circular upwardly extending spring support 126. The head shroud 14A has a socket 26A for a power cord as well as an air inlet opening 18A and an air outlet opening 20A at opposites upper sides.

The head shroud 14A is formed with a semi-circular exhaust partition 34A extending down from the top of the housing 12 roughly ½ inch. The partition 34A is formed with a generally cylindrical nipple 36A extending from an opening 38A in the partition 34A to the outlet opening 20A thereby creating a passage for exhaust air to escape from the housing 12A. The head shroud 14A is also formed with an arcuate baffle 128 extending downwardly from the top of the housing 12 in approximately the same location and of the same configuration as the arcuate wall 110 of the valve head 44 in the above described embodiment.

Like the first embodiment, the housing 12A contains a drive assembly including an electromagnet, a piston 40A, a cylinder/valve head 130 all aligned concentrically about a piston axis 46A. A leaf spring 56A stack is clamped between the spring support 126 and a spacer ring 58A. The spacer ring 58A has notched top and bottom edges. The notch in the bottom edge is sized to mate with the spring support 126, and the upper notch receives the bottom edge of a stator 60A containing a coil 72A (as described above contained in a bobbin 71A and coupled to power with a diode 73A) and an armature 74A. The armature 74A has a downwardly extending hub 78A at its center with an axial bore 80A. The hub 78A is aligned along the piston axis 46A with a connecting rod 82A extending through the center of the stator 60A between the armature 74A and a second leaf spring 88A stack clamped at its outer diameter between a peripheral wall 134 of the stator 60A and a bottom edge of the cylinder/valve head 130 and clamped at its inner diameter between the sleeve 132 and a shaft 102A of the piston 40A. A fastener 136 having an enlarged head and inserted through the inner diameter of the first leaf spring 56A stack, the hub of the armature 74A, the sleeve 132, and the second leaf spring 88A stack threads into a bore in the piston shaft 102A. The piston 40A has an enlarged head 96A defining a recess holding a piston cup 98A clamped to the head 96A by a cup retainer 100A.

The monolithic cylinder/valve head 130 has a cylinder section 140 in which the piston 40A reciprocates and a disk-shaped section 142 having intake port 106A and an exhaust port 108A in communication with the inside of the cylinder section 140 and covered by flapper valves (not shown), as known in the art. Section 142 abuts tightly against the bottom end of the partition 34A to create an exhaust chamber. Preferably, section 142 includes a semi-circular groove at its upper side containing an o-ring seal compressed by the partition 34A. Air exits the exhaust chamber via nipple 36A.

FIGS. 7–11 show another embodiment similar to the last described embodiment wherein the drive assembly is clamped together between the housing parts and wherein the housing has an integral exhaust chamber, however, of a different configuration. Components of this embodiment that are similar to the above described embodiments are referred to with similar reference numerals albeit with the suffix "B".

In particular, the axial piston pump 10B has a compact housing 12B including a head shroud 14B and a rear shroud 16B joined at the bottom of the housing, preferably by heat staking (as known in the art) pins 150B extending from the head shroud through corresponding openings in the bottom of the rear shroud and thereby permanently mating the shrouds. The rear shroud 16B is formed with a ring of upstanding elements defining a circular spring support 126B. The rear shroud 16B has an opening for a power cord 200 and the head shroud 14B has an opening for an on/off switch 202 as well as an air inlet opening 18B and an air outlet opening 20B at opposites upper sides. The head shroud 14B also defines three legs 203 with non-slip fee 20F extending from one side.

The head shroud 14B is formed with an exhaust partition 34B extending down from the top of the housing 12B roughly ½ inch. The partition 34B is generally square and much smaller than in the aforementioned embodiments. A generally cylindrical nipple 36B extends from an opening 38B in the partition 34B to the outlet opening 20B thereby creating a passage for exhaust air to escape from the housing 12B. The head shroud 14B is also formed with an arcuate baffle 128B extending downwardly from the top of the housing 12B. The inlet opening 18B is at the top of the head shroud in this embodiment. In particular, an inlet cap 216 snaps into the inlet opening in the top of the head shroud. The cap 216 has a plurality of small openings that allow air into the inlet chamber defined in part by the arcuate baffle. Like above, the inlet chamber is not closed off from the interior of the housing so that air can circulate through the housing. This as well as a ridge vent 218 and vent opening 219 along opposing sides of the head shroud cools the internal components.

Like the other described embodiments, the housing 12B contains a drive assembly including an electromagnet and a piston 40B although here the cylinder is an aluminum sleeve 210 separate from a plastic valve head 212. These components are aligned concentrically about a piston axis 46B. A leaf spring 56B stack (one shown) is clamped between the spring support 126B and a spacer ring 58B. The spacer ring 58B has notched top and bottom edges. The notch in the bottom edge mates with the spring support 126B and the upper notch receives the bottom edge of a stator 60B containing a coil 72B (as described above contained in a bobbin 71B and coupled to power with a diode 73B) and an armature 74B. The armature 74B has a downwardly extending hub 78B at its center with an axial bore 80B. The hub 78B is aligned along the piston axis 46B with a sleeve 132B extending through the center of the stator 60B between the armature 74B and a second leaf 88B stack clamped at its outer diameter between spacers 220 and collar 222. Spacer 222 has a notched central bore in which fits a bottom end of the cylinder sleeve 210. The top end of the cylinder sleeve fits into a circular groove in the bottom side of the valve head 212. The spring stack 88B is clamped at its inner diameter between the sleeve 210 and a shaft 102B of the piston 40B. A fastener 136B having an enlarged head and inserted through the inner diameter of the first leaf spring 56B stack, the hub of the armature 74B, the sleeve 210, and the second leaf spring 88B stack threads into a bore in the piston shaft 102B. The piston 40B has an enlarged head 96B defining a recess holding a piston cup 98B clamped to the head 96B by a cup retainer 100B.

The generally square valve head has an intake port 106B and an exhaust port 108B in communication with the inside of the cylinder sleeve and covered by flapper valves (not shown), as known in the art. The valve head abuts tightly against the bottom end of the partition 34B to create an exhaust chamber. Although not shown, a resilient seal or gasket can be placed between the valve head and the partition to seal the exhaust chamber. Air exits the exhaust chamber via nipple 36B.

The present invention thus provides a compact axial piston pump with low operating vibration and noise such that is particularly suitable for use in a medical nebulizer device. The drive assembly can be suspended in the housing by spring stacks and top and bottom spring mounts to isolate the housing from vibration caused by the reciprocating elements of the assembly, and thereby reduce noise. The springs are selected so that the spring-mass system has a resonant frequency of approximately the input frequency and thereby improves efficiency and reduces vibration and noise. Additionally, the intake air is directed through the housing cavity by inlet baffles formed in the housing to further reduce noise as well as cool the drive assembly components. The unique exhaust chamber construction of the pump, formed by a partition wall of the housing and a mating wall of the valve head, simplifies assembly and cost by eliminating the need for separate exhaust tubing.

Illustrative embodiments of the present invention have been described above in detail. However, the invention should not be limited to the described embodiments. For example, it is within the scope of the invention to substitute other spring members for the leaf springs described above, such as compression springs or other energy absorbing members made of suitably resilient materials, such as rubber or foam. To ascertain the full scope of the invention, the following claims should be referenced.

What is claimed is:

1. An axial piston pump for use with a nebulizer having a cylinder and piston disposed along a piston axis and an electromagnet having a stator containing a wire coil driving an armature connected to the piston to reciprocate the piston within the cylinder along the piston axis and pass air through a valve head having an intake port and an exhaust port in communication with the cylinder and respective inlet and outlet ports of a two-piece housing, the housing includes a first housing part having an axially extending exterior wall defining an interior cavity containing the cylinder and having an axially extending interior partition wall that mates with the valve head to define an exhaust chamber isolating air at the exhaust port from air at the intake port and, wherein the first housing part further defines an outlet in communication with the exhaust chamber and the outside of the housing.

2. The pump of claim 1, further comprising a seal disposed between the partition and the valve head to seal the exhaust chamber.

3. The pump of claim 1, wherein the first housing part and a second housing part clamp the partition and valve head together to form the exhaust chamber.

4. An axial piston pump for use with a nebulizer having a cylinder and piston disposed along a piston axis and an electromagnet having a stator containing a wire coil driving an armature connected to the piston to reciprocate the piston within the cylinder along the piston axis and pass air through a valve head having an intake port and an exhaust port in communication with the cylinder and respective inlet and outlet ports of a housing, the housing includes a partition defining an exhaust chamber in combination with the valve head to isolate air at the exhaust port from air at the intake port and defines an outlet in communication with the exhaust chamber and the outside of the housing, wherein the valve head is movable with respect to the housing and slidably seals with the partition.

5. The pump of claim 4, wherein the valve head defines a wall surrounding its exhaust port and extending adjacent to the partition so as to axially overlap the partition.

6. The pump of claim 5, further comprising a seal disposed between the housing partition and the valve head.

7. The pump of claim 6, wherein seal is an o-ring disposed in a peripheral groove in the valve head wall.

8. The pump of claim 7, wherein the valve head wall and housing partition are substantially semi-circular.

9. The pump of claim 4, wherein the piston and armature are isolated from the housing by one or more springs.

10. An axial piston pump for use with a nebulizer having a cylinder and piston disposed along a piston axis and an electromagnet having a stator containing a wire coil driving an armature connected to the piston to reciprocate the piston within the cylinder along the piston axis and pass air through a valve head having an intake port and an exhaust port in communication with the cylinder and respective inlet and outlet ports of a housing, the housing includes a partition defining an exhaust chamber in combination with the valve head to isolate air at the exhaust port from air at the intake port and defines an outlet in communication with the exhaust chamber and the outside of the housing, wherein the housing further defines an inlet in communication with an exterior of the housing and an interior of the housing and the intake port and wherein the housing further defines a baffle disposed to interrupt flow between the inlet and the intake port.

* * * * *